United States Patent [19]

Burnett et al.

[11] Patent Number: 4,902,306

[45] Date of Patent: Feb. 20, 1990

[54] DUAL-DIPOLE ELECTROSTATIC AIR FILTER

[75] Inventors: Gilbert W. Burnett; Paul D. Jackson, both of Rockwall, Tex.

[73] Assignee: Air Purification Products International, Inc., Royse City, Tex.

[21] Appl. No.: 230,075

[22] Filed: Aug. 9, 1988

[51] Int. Cl.[4] ..... B03C 3/02

[52] U.S. Cl. ..... 55/6; 55/103; 55/155; 55/131; 55/486; 55/528; 55/DIG. 31; 55/DIG. 45

[58] Field of Search ..... 55/103, 2, 6, 131, 155, 55/486, 487, DIG. 31, DIG. 45, 528; 428/286, 287; 210/505

[56] References Cited

U.S. PATENT DOCUMENTS

| | | | |
|---|---|---|---|
| 2,597,927 | 5/1952 | Endres | 55/DIG. 31 |
| 2,804,937 | 9/1957 | Poole | 55/103 |
| 3,237,387 | 3/1966 | Haugen et al. | 55/103 |
| 3,307,332 | 3/1967 | Grace et al. | 55/103 |
| 3,449,094 | 6/1969 | Baxt et al. | 29/195 |
| 3,487,610 | 1/1970 | Brown et al. | 55/130 |
| 4,115,082 | 9/1978 | Newell | 55/103 |
| 4,185,972 | 1/1980 | Nitta et al. | 55/155 |
| 4,323,374 | 4/1982 | Shinagawa et al. | 55/132 |
| 4,518,402 | 5/1985 | Dargel | 55/103 |
| 4,749,390 | 6/1988 | Burnett et al. | 55/316 |

FOREIGN PATENT DOCUMENTS

| | | | |
|---|---|---|---|
| 2384532 | 2/1977 | France . | |
| 78917 | 5/1982 | Japan | 55/103 |

OTHER PUBLICATIONS

Frederick E. R., How Dust Filter Selection Depends on Electrostatics Chem. Engr., 6/26/61, pp. 107–114.

"Self-Charging Electrostatic Air Filters", W. T. Van Orman and H. A. Endres, Heating, Piping & Air Conditioning, Jan. 1952.

*Primary Examiner*—Bernard Nozick

*Attorney, Agent, or Firm*—Baker, Mills & Glast

[57] ABSTRACT

A filter assembly (10) for removing particulate matter from air forced therethrough comprises two pairs of oppositely charged woven electrostatic filtering material. Each pair of electrostatic filtering material comprises a positively charged and a negatively charged layer (22, 24, 28 and 30). An open cell foam layer (26) is disposed between the two pairs. Metal grids (20,32) enclose the filtering elements.

4 Claims, 1 Drawing Sheet

DUAL-DIPOLE ELECTROSTATIC AIR FILTER

TECHNICAL FIELD OF THE INVENTION

This invention pertains in general to air filtering devices, and more particularly to an electrostatic air filter.

BACKGROUND OF THE INVENTION

The principle of electrostatic filtering has been known for many years. Under the influence of an air stream, certain materials which are normally dielectric will obtain an electrostatic charge. The electrostatic charge attracts dust particles from the air stream, thereby filtering air. Tests have shown that self-charging electrostatic air filters provide superior filtration as compared with conventional impingement type filters which collects dust through contact with the dust particles.

U.S. Pat. No. 4,115,082 to Newell discloses an air cleaner assembly having outer sheets of polypropylene overlying two series of rigid thermoplastic rods. A central element of open-cell foam rubber is sandwiched between the two series of rods. It is claimed that the rods and central element develop a positive electrostatic charge while the outer polypropylene material develops a negative charge, increasing the efficiency of the filtration.

Because of the thermoplastic rods, the construction of the filter disclosed in U.S. Pat. No. 4,115,082 has proven to be quite expensive. Furthermore, while it is doubtful that the plastic rods can develop enough charge to significantly effect the filtration; they may increase the resistance to airflow. Independent tests have shown that the filtration efficiency of the unit of this type is only about 85% using ASHRAE 52-76 test procedures.

Therefore, a need has arisen in the industry to provide a low-cost electrostatic air filter having enhanced filtration capabilities.

SUMMARY OF THE INVENTION

In accordance with the present invention, an air filter is provided which substantially eliminates or prevents the disadvantages and problems associated with prior electrostatic air filters.

In the first embodiment of the present invention, the air filter comprises two layers of woven electrostatic material, typically polypropylene, which are disposed adjacent each other. The first layer of electrostatic material is such that a positive charge will develop in response to air flow therethrough, while the second layer of electrostatic material is chosen such that a negative charge will develop in response of air flow therethrough. This filter has been found to have superior air filtering characteristics.

In a second aspect of the present invention, two pairs of electrostatic woven material are provided, each pair having a positively charged electrostatic material and a negatively charged electrostatic material. The pairs of electrostatic filter layers are separated by an open-cell foam material, such as polyurethane, which also has electrostatic properties. Typically, the polyurethane has a thickness of approximately one-quarter of an inch. This embodiment of air filter of the present invention has been found to offer improved filtering characteristics.

In a third embodiment of the present invention, metal grids are placed before and after the electrostatic filtering material. It is believed the metal grids provide a grounding plane which increases the electrostatic effect, thereby increasing the filtering efficiency.

BRIEF DESCRIPTION OF THE DRAWINGS

For a more complete understanding of the present invention and the advantages thereof, reference is now made to the following descriptions taken in conjunction with the accompanying drawings, in which.

DETAILED DESCRIPTION OF THE INVENTION

Figure 1:
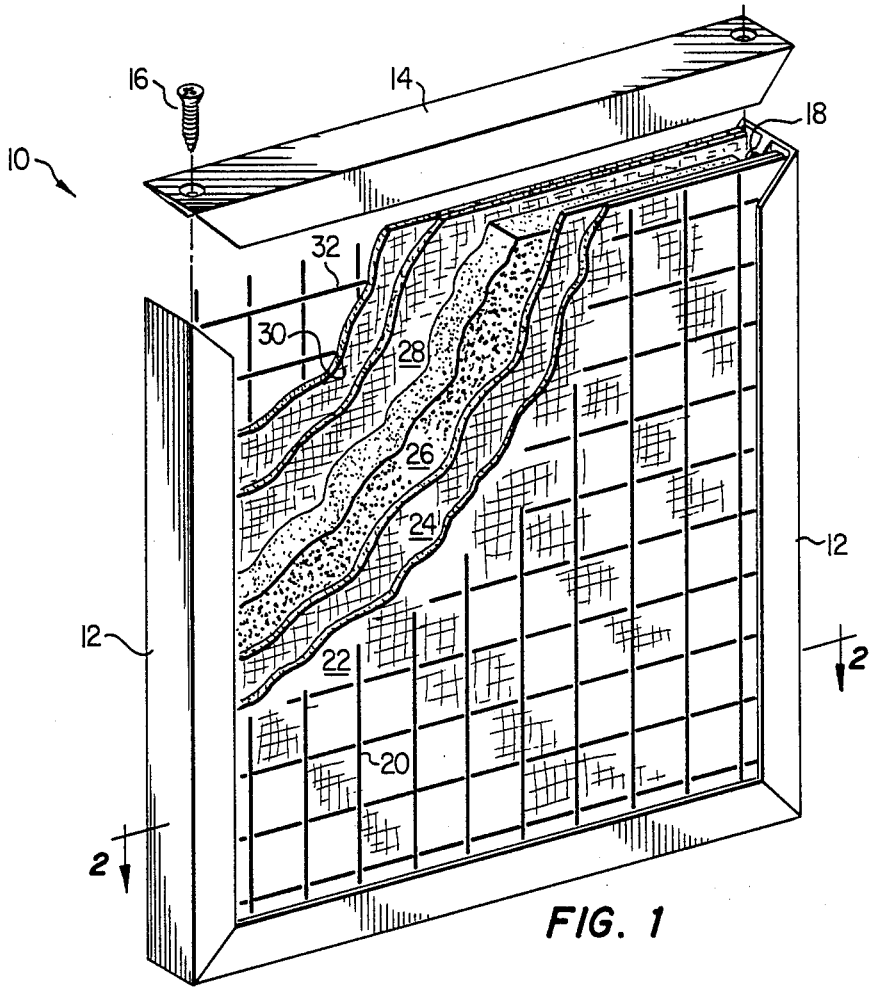
FIG. 1 is a perspective view of the air filter of the present invention having a cut-away portion exposing the various filtering layers.
Figure 2:
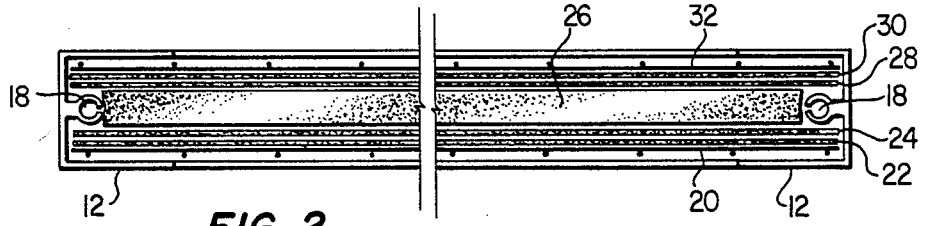
FIG. 2 is a top plan view of the air filter of FIG. 1 with the top cover removed.

The preferred embodiment of the present invention is best understood by referring to FIGS. 1–2 of the drawings, like numerals being used for like and corresponding parts of the various drawings.

FIG. 1 illustrates a perspective view of an air filter 10, with a cut-away view of the various layers thereof. The air filter 10 comprises an outer frame 12 having a top portion 14 attached thereto by screws 16 secured in an integral screw boss 18. The frame 12 contains a plurality of filtering elements. A first wire grid 20 is placed in front of a first layer of woven electrostatic material 22. A second layer of woven electrostatic material 24 is placed between the first layer of woven electrostatic material 22 and a layer of open-cell foam 26. Third and fourth layers of woven electrostatic material 28 and 30 are placed behind the open-cell foam layer 26, and are held within the frame by a second wire grid 32.

In the preferred embodiment, the first layer of electrostatic material 22 comprises a material which will develop a positive electrostatic charge in response to air flow therethrough (hereinafter a "positive electrostatic material"). The second layer 24 comprises a negative electrostatic material, the third layer 28 comprises a positive electrostatic material and the fourth layer 30 comprises a negative electrostatic material. Typically, the layers of woven electrostatic material 22, 24, 28 and 30 are formed from interwoven fibers of polypropylene. Sheets of the polypropylene material, both positive and negative, can be obtained under the tradename LUMITE. Other materials exhibiting electrostatic properties are listed in W. Orman and H. Endress, "Self-Charging Electrostatic Air Filters," Heating, Piping and Air Conditioning, Jan. 1952.

The open-cell foam layer 26 has a preferable thickness of approximately one-quarter to three-eighths of an inch. The open-cell material will acquire an electrostatic charge in response to the air flow therethrough, and it is believed that the charge developed across the open-cell foam layer 26 enhances the polarity difference between the two pairs of woven electrostatic material layers 22 and 24 and 28 and 30. By providing a relatively thick separation, the foam layer 26 also prevents accumulated dust from discharging the electric field between the two pairs of woven material. Retaining the electrostatic charge throughout the filter maintenance cycle increases the dust holding capacity of the filter. In addition to its electrostatic filtering properties, the open-cell foam layer 26 acts as a conventional impingement type filter and also diffuses the dust particles in the air stream to create vertical as well as horizontal movement of the particles, thereby increasing the efficiency of woven layers 28 and 30.

The wire grids 20 and 32 serve two purposes. First, the wire grids serve to retain the filtering layers 22, 24, 28 and 30 within the outer frame 12. Second, test have shown that the wire grids improve the filtering capabilities of the air filter 10. It is believed that the wire grids 20 and 32 act as grounding planes which enhance the electrostatic effects of the filtering layers 22, 24, 28 and 30. In the preferred embodiment, the wire grids 20 and 32 comprises painted metal wires of approximately 1/20 -1/16 inches in diameter, arranged in a grid. The spacing between parallel wires is approximately one-half of an inch. It is believed that other configurations of wire will also serve to be an effective grounding plane.

The filter of the present invention has been proven in accordance with ASHRAE 52-76 test procedures to exceed the performance of a commercial embodiment of the filter of U.S. Pat. No. 4,115,082. The prior art filter has been tested as having a resistivity of 0.17 wg and filtering efficiency of 85% (percentage of particles removed) in Air Filter Testing Report #4371. By contrast, the filter of the present invention has been tested to have a resistance of 0.15 wg and a filter efficiency of 93% as evidenced by Air Filter Testing Report #4792, dated May 25, 1988. Hence, the filter of the present invention provides significant filtering capabilities of that of the prior art.

Furthermore, the air filter 10 can be easily and inexpensively assembled and disassembled. Cleaning is accomplished merely by forcing water through the filter elements using an ordinary water hose. All filter elements are extremely durable and will therefore require no maintenance by the user other than routine cleaning.

Although a preferred embodiment of the present invention has been described in detail, it should be understood that various changes, substitutions and alterations can be made therein without departing from the spirit and scope of the invention as defined by the appended claims.

What is claimed is:

1. An air filter assembly comprising:

a first filter pair comprising a first positively chargeable woven polypropylene electrostatic filtering element and a first negatively chargeable woven polypropylene electrostatic filtering element, said first positive and negative filtering elements being in contact with each other such that air being filtered must flow through both elements of the first filter pair;

a second filter pair comprising a second positively chargeable woven polypropylene electrostatic filtering element and a second negatively chargeable woven polypropylene electrostatic filtering element, said second positive and negative filtering elements being in contact with each other such that air being filtered must also flow through both elements of the second filter pair;

an open cell polyurethane foam layer disposed between said first and second filter pairs such that air being filtered must also flow through the foam layer; and first and second metal grids operable to act as grounding planes for said first and second filter pairs.

2. The air filter assembly of claim 1 wherein said open cell polyurethane foam layer has a thickness of at least one-quarter of an inch.

3. The air filter assembly of claim 1 wherein said open cell polyurethane foam layer is operable to develop an electrostatic charge in response to air flow therethrough.

4. A method of filtering air comprising the steps of:

filtering air through a first positively charged woven polypropylene electrostatic filtering element and a first negatively charged woven polypropylene electrostatic filtering element adjacent said first positively charged woven polypropylene electrostatic filtering element;

filtering the air through an open cell polyurethane foam layer after said steps of filtering the air through said first positively charged and said first negatively charged electrostatic filtering elements; and filtering air through a second positively charged woven polypropylene electrostatic filtering element and a second negatively charged woven polypropylene electrostatic filtering element adjacent said first positively chargeable woven polypropylene electrostatic filtering element after filtering the air through said polyurethane foam layer.

* * * * *